US007441489B1

(12) United States Patent
Bennett et al.

(10) Patent No.: US 7,441,489 B1
(45) Date of Patent: Oct. 28, 2008

(54) MORTAR BOMB POSITIONING APPARATUS

(75) Inventors: Leon J. Bennett, Voorheesville, NY (US); Donald G. Forkas, Rexford, NY (US); George E. Hathaway, IV, Sprakers, NY (US); Ronald G. Gast, Cohoes, NY (US); Ronald S. Jacobs, Contoocook, NH (US); Henry Sneck, West Sand Lake, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 132 days.

(21) Appl. No.: 11/427,073

(22) Filed: Jun. 28, 2006

(51) Int. Cl.
*B64D 1/04* (2006.01)

(52) U.S. Cl. ..... 89/1.35

(58) Field of Classification Search ..... 89/1.1, 89/1.11, 1.35, 37.05, 45
See application file for complete search history.

(56) References Cited

U.S. PATENT DOCUMENTS 1,462,500 A * 7/1923 Wells ..... 89/1.1
1,757,675 A * 5/1930 Methlin ..... 89/1.35
2,382,225 A * 8/1945 Hochstetler ..... 89/1.35
2,809,624 A * 10/1957 Becher et al. ..... 124/77
2,882,796 A * 4/1959 Clark et al. ..... 89/7
4,660,458 A * 4/1987 von Laar et al. ..... 89/25
4,982,646 A * 1/1991 Machmer ..... 89/1.35
5,677,507 A * 10/1997 Becker et al. ..... 89/47
7,040,211 B1 * 5/2006 Bennett et al. ..... 89/1.35
2004/0244572 A1 * 12/2004 Borgwarth et al. ..... 89/17

* cited by examiner

*Primary Examiner*—Bret Hayes
(74) *Attorney, Agent, or Firm*—Michael Sachs

(57) ABSTRACT

A mortar munition includes a mortar tube; first and second openings in the wall of the mortar tube, the first opening being closer to a breech end of the mortar tube than the second opening; a spring loaded valve assembly disposed in the first opening in the wall of the mortar tube; and a shoe assembly disposed in the second opening in the wall of the mortar tube. The spring loaded valve assembly is connected to a vacuum source. The vacuum source pulls the mortar bomb rearward in the tube. The shoe assembly includes a shoe that bears on the mortar bomb to hold it in place when the tube is in an elevated position.

14 Claims, 3 Drawing Sheets

MORTAR BOMB POSITIONING APPARATUS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar munitions and in particular to breech loaded mortar munitions.

In the past, mortars have been muzzle loaded. With muzzle loaded mortars, the position of the mortar bomb in the mortar tube is not an issue. In a breech loaded mortar, a mechanical auto loader pushes the mortar bombs into the mortar tube through the open breech end. In general, it is desirable that the auto loader push the mortar bomb a bit further down the tube than the final firing position of the bomb. This allows the breech to be closed without fear of striking the bomb. After closing the breech, the mortar bomb must be moved rearward in the tube to its correct firing position. Thus, a device is needed to move the bombs rearward from their loaded position to their firing position.

Another problem occurs when the mortar tube is in an elevated position (i.e., not horizontal). At high elevations, the mortar bomb may fall out of the breech during retraction of the auto loader. Then, the breech block will strike the bomb when the breech is closed. U.S. Pat. No. 7,040,211 issued on May 9, 2006 discloses a mortar bomb retention apparatus and is incorporated by reference herein. That apparatus can prevent the mortar bomb from falling out of the breech when the mortar tube is in an elevated position. However, that apparatus is not able to retract a mortar bomb that was positioned or has moved too far down the tube, when the mortar tube is at horizontal or near horizontal elevation. Therefore, there is a need for an apparatus to work in unison with the mortar bomb retention apparatus to properly position the mortar bomb in the tube.

SUMMARY OF THE INVENTION

A primary object of the invention is to provide an apparatus to properly position a breech loaded mortar bomb in the mortar tube.

Another object of the invention is to provide an apparatus that prevents the mortar bomb from falling out of the breech when the mortar tube is in an elevated position and also retracts the mortar bomb that has been loaded too far down the tube away from the breech end.

One aspect of the invention is a mortar munition comprising a mortar tube; first and second openings in the wall of the mortar tube, the first opening being closer to a breech end of the mortar tube than the second opening; a spring loaded valve assembly disposed in the first opening in the wall of the mortar tube; and a shoe assembly disposed in the second opening in the wall of the mortar tube. A vacuum source is connected to the spring loaded valve assembly.

The mortar munition further comprises a first solenoid having a plunger, the plunger being disposed to open the spring loaded valve assembly. The first solenoid is attached to a first recoilless mass. A fire control computer is electrically connected to the first solenoid.

The spring loaded valve assembly comprises a valve disposed in a housing, the housing being disposed in the opening in the wall of the mortar tube; a valve cap on one end of the valve, the valve cap for interacting with the solenoid plunger; and a compression spring disposed around the valve for keeping the valve normally closed. A vacuum connection is rotatably attached to the housing.

The shoe assembly comprises a lever arm; a lever positioner in which the lever arm is rotatably mounted; a generally cylindrical housing having a central opening therethrough, the central opening comprising a large diameter portion and a small diameter portion, the lever positioner being fixed to the housing; a shoe disposed in the central opening in the housing; a compression spring disposed around the shoe in the large diameter portion of the central opening; and a shoe cap attached to an end of the shoe, one end of the compression spring bearing against the shoe cap, a portion of the lever arm contacting the shoe cap wherein rotation of the lever arm is operable to force the shoe downward.

The mortar munition further comprises a second solenoid having a plunger wherein the plunger is operable to rotate the lever arm. The second solenoid is attached to a second recoilless mass. The fire control computer is electrically connected to the second solenoid.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
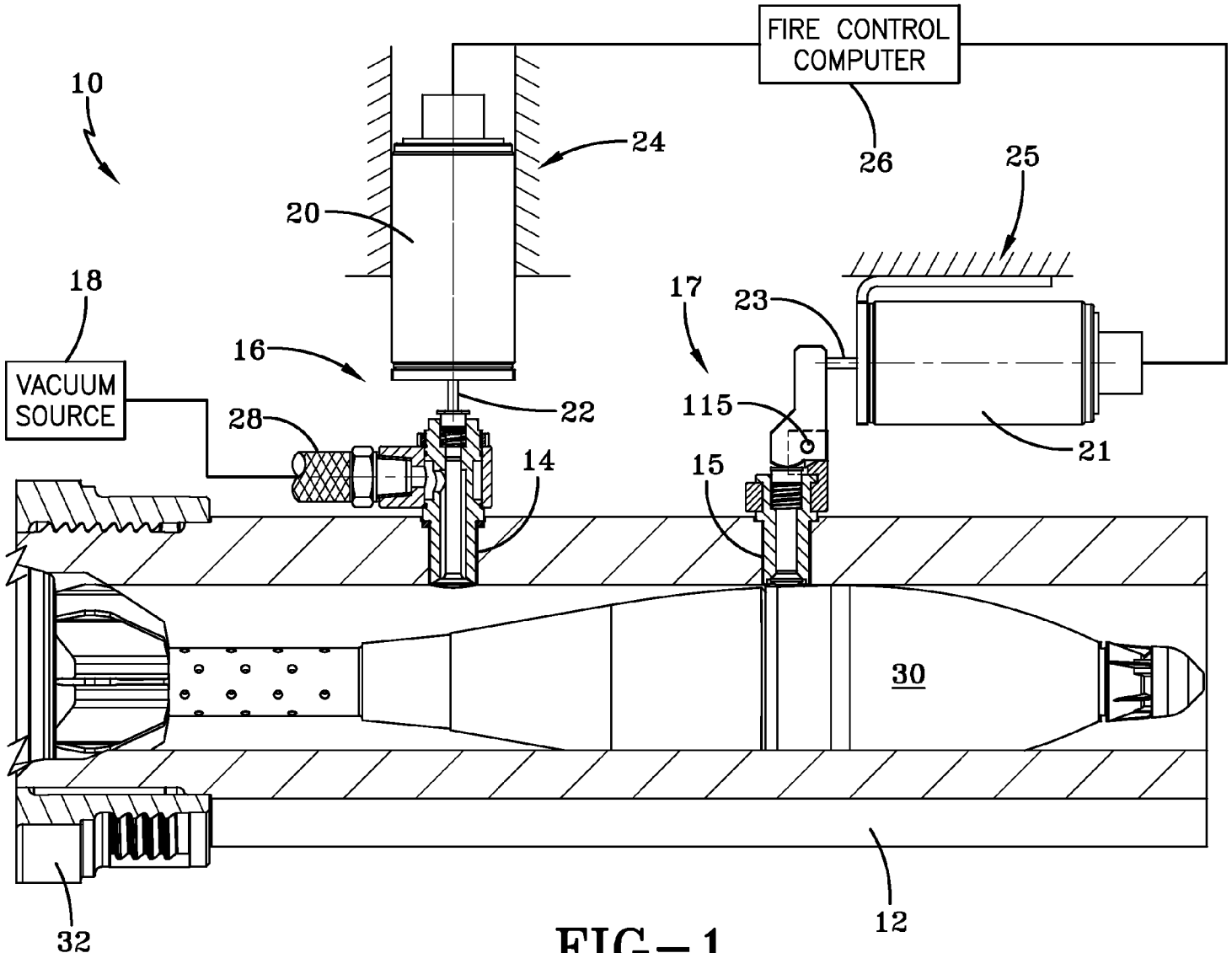
FIG. 1 is a side view, partially in section, of one embodiment of a mortar munition in accordance with the invention.

Referring now to FIG. 1, one embodiment of a mortar munition 10 in accordance with the invention comprises a mortar tube 12 having a wall with first and second openings 14, 15 therein. The first opening 14 is closer to the breech end 32 of the mortar tube 12 than the second opening 15. A spring loaded valve assembly 16 is disposed in the first opening 14 and a shoe assembly 17 is disposed in the second opening 15. A first solenoid 20 includes a plunger 22 that interacts with the spring loaded valve assembly 16. A vacuum source 18 is connected to the spring loaded valve assembly 16 via vacuum line 28. The first solenoid 20 is attached to a first recoilless mass 24. A fire control computer 26 is electrically connected to the first solenoid 20. A second solenoid 21 includes a plunger 23 that interacts with the shoe assembly 17. The second solenoid 21 is attached to a second recoilless mass 25. Depending on the particular munition, first and second recoilless masses 24, 25 may be the same or different masses.

Figure 2:
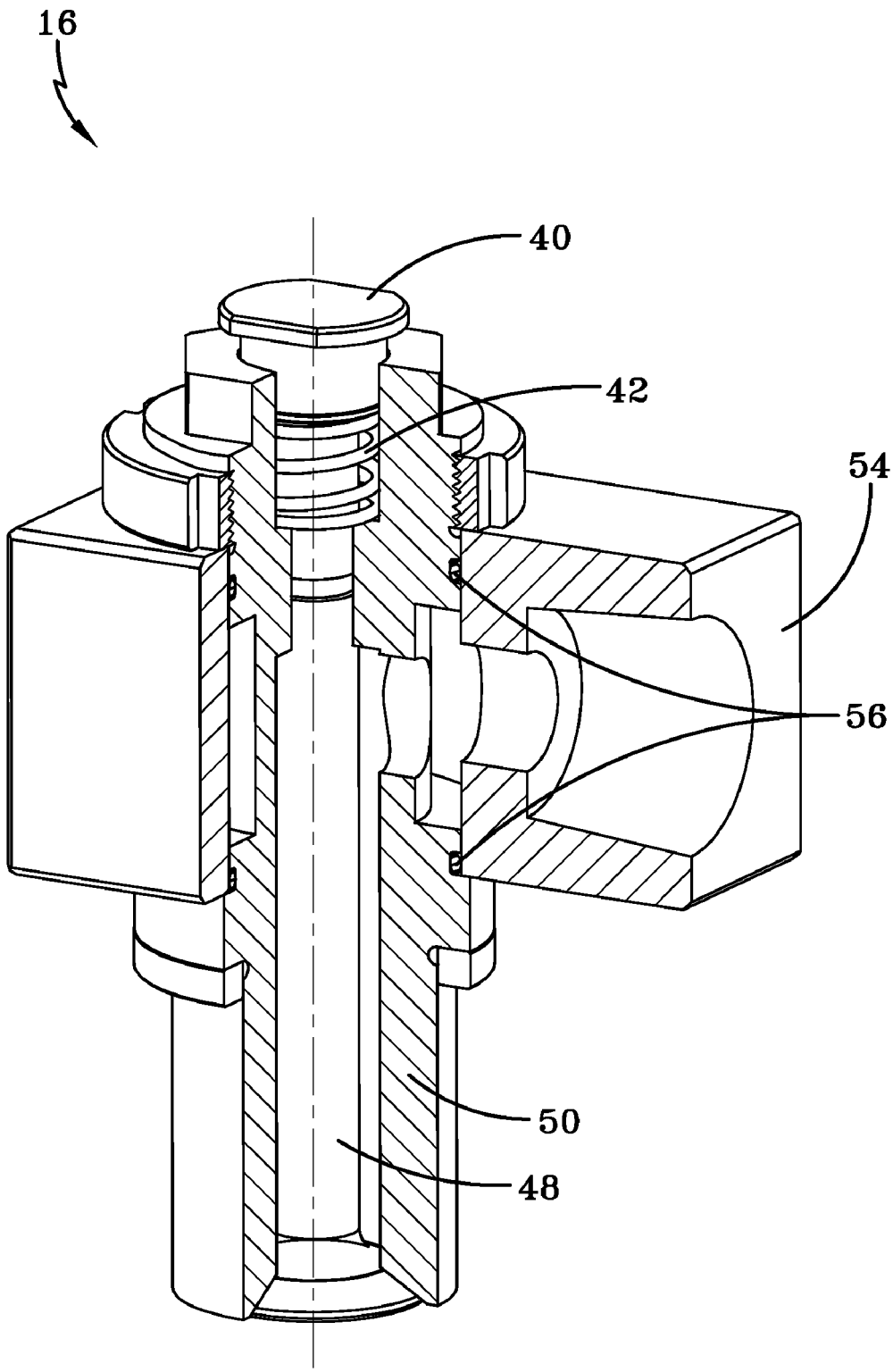
FIG. 2 is a perspective view, partially in section, of one embodiment of a spring loaded valve assembly.

Referring to FIG. 2, the spring loaded valve assembly 16 comprises a valve 48 disposed in a housing 50. The housing 50 is disposed in the opening 14 (FIG. 1) in the wall of the mortar tube 12. One end of the valve 48 includes a valve cap 40 that interacts with the solenoid plunger 22. A compression spring 42 is disposed around the valve 48 for keeping the valve 48 normally closed. A vacuum connection 54 is attached to the housing 50. The vacuum connection 54 is preferably rotatable around the housing 50. To this end, O-rings 56 seal the vacuum connection 54 to the housing 50. The rotatable vacuum connection 54 is desirable so that the vacuum line 28 may be connected to the assembly 16 in any orientation.

Figure 3:
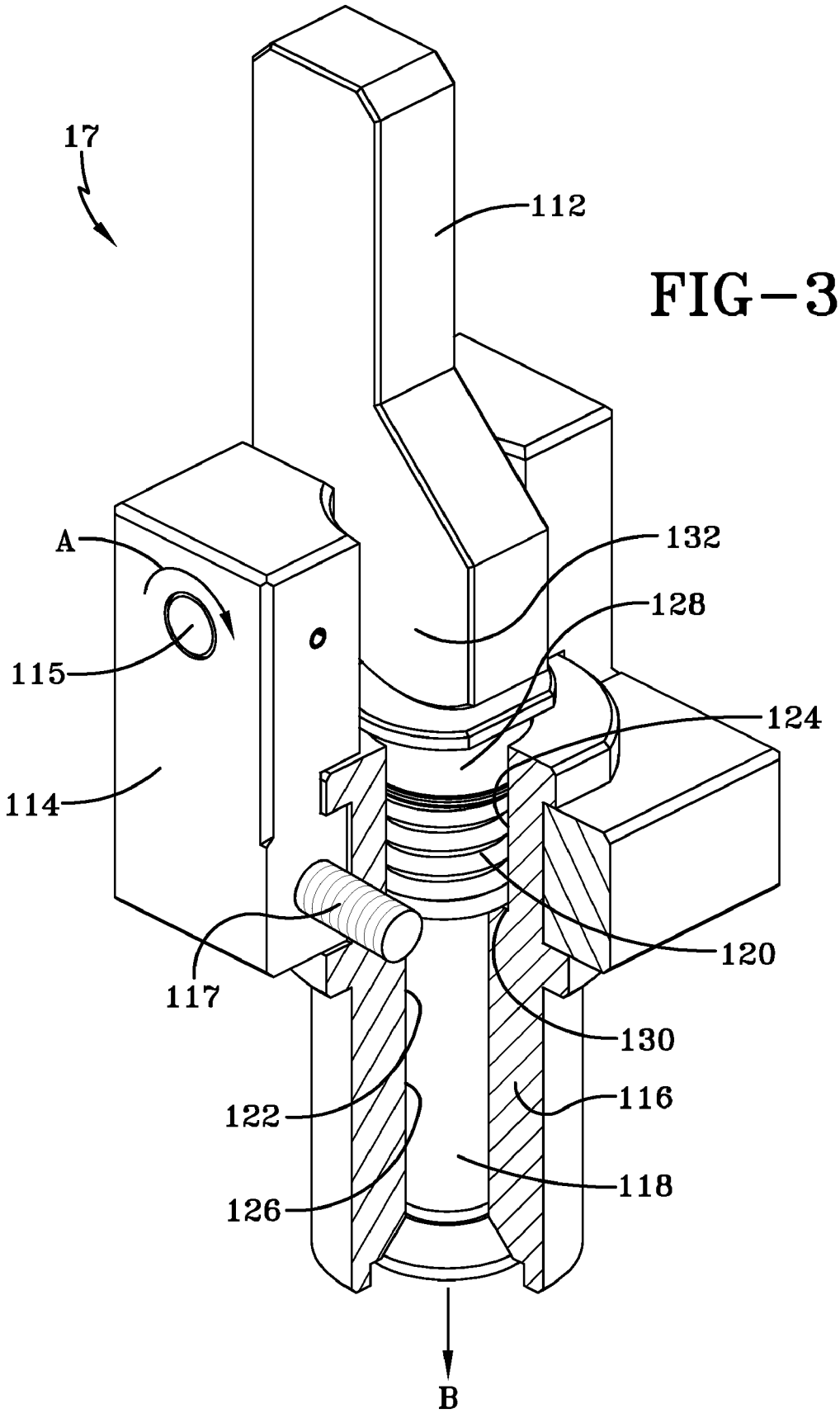
FIG. 3 is a perspective view, partially in section, of one embodiment of a shoe assembly.

FIG. 3 is a perspective view, partially in section, of an embodiment of a shoe assembly 17 according to the invention. The shoe assembly 17 includes a lever arm 112 and a lever positioner 114 in which the lever arm 112 is rotatably mounted using, for example, pin 115. A generally cylindrical housing 116 has a central opening 122 therethrough. The central opening comprises a large diameter upper portion 124 and a small diameter lower portion 126. The lever positioner 114 is fixed around housing 16 using screws 117. A shoe 118 is disposed in the central opening in the housing 116. A compression spring 120 is disposed around the shoe 118 in the large diameter portion 124 of the central opening. A shoe cap 128 is attached to the upper end of the shoe 118.

The central opening 122 includes a step 130 located between the large and small diameter portions 124, 126. One end of the compression spring 120 bears against the step 130 and another end of the compression spring 120 bears against shoe cap 128. A lower portion 132 of the lever arm 112 is in contact with the shoe cap 128. FIG. 3 shows lever arm 112 in the upright position and shoe 118 in the retracted position inside housing 116. When the lever arm 112 is rotated in the direction shown by arrow A in FIG. 3, the shoe 118 moves downward as shown by arrow B. When the force moving lever arm 112 is removed, compression spring 120 moves lever 112 back to its upright position and shoe 118 is retracted back into housing 116.

Referring also to FIG. 1, second solenoid 21 includes a plunger 23 that contacts lever arm 112 and is operable to rotate lever arm 112. In FIG. 1, rotation of lever arm 112 is counter clockwise around pin 115. Lever arm 112 typically rotates, for example, twenty degrees. Mortar tube 12 includes second opening 15 in its wall into which housing 116 is disposed. Housing 116 may be provided with external threads that engage internal threads in the opening 15. Housing 116 is mounted so that the end of the housing is flush with the interior surface of tube 12.

The invention operates in two primary modes, depending on the elevation of the mortar tube 12. One mode of operation is with the mortar tube 12 horizontal (zero elevation) or nearly horizontal and the other mode of operation is with the mortar tube 12 elevated. With the mortar tube at zero elevation, a breech loaded mortar bomb 30 may "thrown down" the tube 12, out of firing position, by an auto loader or operating personnel. To prevent this, the fire control computer 26 operates the solenoid 21 in a "pulse" mode. In the pulse mode, the fire control computer 26 sends a rapid series of on and off signals to solenoid 21 that causes the shoe 118 to alternately extend into and retract from the mortar tube 12. The alternating contact with the shoe 118 slows down the travel of the breech loaded mortar bomb 30 and prevents it from traveling too far down the tube. Prior to firing the mortar bomb, the pulse mode is disabled and the shoe 118 is completely retracted from the tube 12.

To ensure that the breech 32 does not strike the bomb 30 when the breech is closed, the position of the bomb 30 is positioned forward of the correct firing position. When the fire control computer 26 senses that the breech 32 is closed, a signal is sent to solenoid 20 and plunger 22 pushes on valve cap 40 to open valve 48. When valve 48 is open, vacuum source 18 is fluidly connected to the space behind the maximum diameter portion of mortar bomb 30, thereby pulling the bomb 30 rearward to its correct firing position. The correct firing position is shown in FIG. 1. Plunger 22 then retracts and compression spring 42 forces valve 48 to the normally closed position. The mortar munition 10 may then be fired. During recoil, the plunger 22 is not in contact with the valve cap 40 so that the assembly 16 is free to recoil with the tube 12.

When the mortar tube 12 is used in an elevated position, it is necessary to hold the mortar bomb 30 in the tube away from the breech 32 while the breech is being closed. With the mortar tube 12 elevated, the bomb 30 is breech loaded (The shoe 118 is in the inactive, retracted position.) to a point in the tube forward of the firing position. Once the bomb 30 is in that position, the computer 26 activates the shoe 118, thereby holding the bomb 30 in place. The breech is then able to close without the bomb 30 falling back out of the breech. Once the breech is closed, the shoe 118 is retracted and gravity allows the bomb 30 to fall against the breech into the firing position.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A mortar munition, comprising:

a mortar tube;

first and second openings in the wall of the mortar tube, the first opening being closer to a breech end of the mortar tube than the second opening;

a spring loaded valve assembly disposed in the first opening in the wall of the mortar tube; and a shoe assembly disposed in the second opening in the wall of the mortar tube.

2. The mortar munition of claim 1 further comprising a first solenoid having a plunger, the plunger being disposed to open the spring loaded valve assembly.

3. The mortar munition of claim 2 further comprising a vacuum source connected to the spring loaded valve assembly.

4. The mortar munition of claim 3 further comprising a first recoilless mass, the first solenoid being attached to the first recoilless mass.

5. The mortar munition of claim 4 further comprising a fire control computer electrically connected to the first solenoid.

6. The mortar munition of claim 1 wherein the spring loaded valve assembly comprises a valve disposed in a housing, the housing being disposed in the opening in the wall of the mortar tube; a valve cap on one end of the valve, the valve cap for interacting with the solenoid plunger; and a compression spring disposed around the valve for keeping the valve normally closed.

7. The mortar munition of claim 6 further comprising a vacuum connection attached to the housing.

8. The mortar munition of claim 7 wherein the vacuum connection is rotatably attached to the housing.

9. The mortar munition of claim 5 wherein the shoe assembly comprises a lever arm; a lever positioner in which the lever arm is rotatably mounted; a generally cylindrical housing having a central opening therethrough, the central opening comprising a large diameter portion and a small diameter portion, the lever positioner being fixed to the housing; a shoe disposed in the central opening in the housing; a compression spring disposed around the shoe in the large diameter portion of the central opening; and a shoe cap attached to an end of the shoe, one end of the compression spring bearing against the shoe cap, a portion of the lever arm contacting the shoe cap wherein rotation of the lever arm is operable to force the shoe downward.

10. The mortar munition of claim 9 further comprising a second solenoid having a plunger wherein the plunger is operable to rotate the lever arm.

11. The mortar munition of claim 10 further comprising a second recoilless mass, the second solenoid being attached to the second recoilless mass.

12. The mortar munition of claim 9 wherein the housing of the shoe assembly is fixed in the second opening in the wall of the mortar tube.

13. The mortar munition of claim 9 wherein the central opening of the shoe assembly housing includes a step located between the large and small diameter portions, another end of the compression spring bearing against the step.

14. The mortar munition of claim 10 wherein the fire control computer is electrically connected to the second solenoid.

* * * * *